US005207596A

United States Patent [19]

Tran

[11] Patent Number: 5,207,596

[45] Date of Patent: May 4, 1993

[54] SOLDERLESS COAXIAL WIRE CONNECTOR AND METHOD FOR ATTACHMENT

[75] Inventor: Nam D. Tran, Fort Worth, Tex.

[73] Assignee: Tandy Corporation, Fort Worth, Tex.

[21] Appl. No.: 853,666

[22] Filed: Mar. 19, 1992

[51] Int. Cl.[5] ..... H01R 13/00

[52] U.S. Cl. ..... 439/585

[58] Field of Search ..... 439/578-585, 439/877, 879, 882

[56] References Cited

U.S. PATENT DOCUMENTS

| | | | |
|---|---|---|---|
| 1,706,005 | 3/1929 | Thompson . | |
| 2,501,870 | 3/1950 | Malhiot . | |
| 2,736,872 | 2/1956 | Heath et al. | 439/585 |
| 2,941,028 | 6/1960 | Elden et al. | 439/585 |
| 3,103,548 | 9/1963 | Concelman . | |
| 3,221,290 | 11/1965 | Stark et al. . | |
| 3,227,993 | 1/1966 | Bentley | 439/585 |
| 3,295,094 | 12/1966 | DeLyon et al. | 439/585 |
| 3,297,979 | 1/1967 | O'Keefe et al. . | |
| 3,728,787 | 4/1973 | McDonough . | |
| 4,135,776 | 1/1979 | Ailawadhi et al. . | |
| 4,269,469 | 5/1981 | Audic . | |
| 4,690,481 | 9/1987 | Randolph . | |
| 4,966,560 | 10/1990 | Marzouk . | |

FOREIGN PATENT DOCUMENTS

| | | |
|---|---|---|
| 1124349 | 8/1925 | Canada . |
| 2382112 | 9/1978 | France . |
| 2601196 | 1/1988 | France . |
| 764654 | 12/1956 | United Kingdom . |
| 1109914 | 4/1968 | United Kingdom . |

*Primary Examiner*—Joseph H. McGlynn
*Attorney, Agent, or Firm*—Keith Hargrove

[57] ABSTRACT

An improved coaxial cable connector and method for attaching the same to a coaxial cable is disclosed. The improved cable connector comprises a center conductor pin, which may be hollow or solid, for providing electrical conductivity for the center wire, an outer conductor shell, which is concentric to the center pin, for providing electrical conductivity for the shielding wire, and an annular dielectric, such as a phenolic washer, mounted to the center conductor pin for insulating the conductor pin from the outer conductor shell. The improvement lies in the use of an inner wire receptor having a funnel portion for receiving the center wire and a holding portion, which is crimped, for mechanically and electrically securing the center wire. The connector is further improved by included an outer wire receptor, which mechanically and electrically secures the shielding wire by crimping, and an insulator receptor, which insulates the center wire and inner wire receptor from the shielding wire and outer wire receptor. The outer wire receptor is further improved by including a funnel portion concentric with the funnel portion of the inner wire receptor. Likewise, the insulator receptor also includes a funnel portion concentric with the funnel portion of the inner wire receptor.

23 Claims, 3 Drawing Sheets

1/3

SOLDERLESS COAXIAL WIRE CONNECTOR AND METHOD FOR ATTACHMENT

BACKGROUND OF THE INVENTION

The present invention relates generally to coaxial cable connectors and, more particularly, to a novel cable connector for solderlessly connecting to a standard coaxial wire, wherein the coaxial connector is either an RCA or other type coaxial cable connector.

Coaxial cable connectors are well known in the art. Currently, coaxial cables with coaxial connectors, which are electrically and mechanically connected with solder, require a detailed method of assembly. This method has many limitations, namely, many of the steps are performed by hand. As such, the labor cost of assembly can be the difference between being a profitable or unprofitable commercial product. In addition, hand labor poses risks to the laborer. Sharp cutting blades and hot soldering irons are used that can injure a laborer who is inattentive. In addition, the wire filaments used in either the center conductor or in the braided outer wire can prick the fingers or hands of the laborer.

These risks have been reduced by making the equipment safer to operate, but at an increased cost of production due to the additional safety features, which inherently reduces throughput of product. The soldering of the wire leads to the cable connectors also has problems. One problem is if the temperature is too hot the lead assembly can melt. If the solder is too cold or weak, the solder joint is "cold" and can fail easily. In addition, the connector can be shorted inadvertently between the first and second conducting elements if stray wire fold back within the connector during assembly and contact both leads. Moreover, the coaxial cables are cut to a specific length, and if a short or weak connection should occur, they cannot be re-used, which results in wasted materials and increased production cost.

Another step used in manufacturing cable connectors is that of molding insulating materials around the outer surface of the cable connector. Occasionally, stray wires from the braided portion of the cable can protrude through this molded portion, thus making the cable defective for commercial use.

The following is a brief outline of the steps used in the hand assembly of soldered coaxial plugs, such as, for example, RCA plugs. First the cable is measured to length and cut. Next, a portion of the outer jacket is stripped from each end to expose the braided wire underneath. This braided wire is debraided, or frayed, by hand insertion into a braid machine, and then subsequently twisted on a twister machine. Next, a portion of the insulation surrounding the inner wire is stripped to expose the inner wire. The inner wire is twisted and then a conductor is placed on the end with a portion of the center wire extending out an opening at the tip of the center conductor, or pin, of the conductor plug. This portion is dipped into solder, and then cleaned and filed. Next, the twisted braid portion is soldered to the shell with a soldering iron, and then the soldered portion is trimmed with a wire cutter. Finally, each end is ready for a plug molding step to cover the outer shell of the connector portion.

A solution to the soldering of coaxial connector plugs to a coaxial cable has been to crimp the connector to the wire. Most forms of crimping use a process of crimping the very tip of the center conductor pin. For some methods this may be the only crimp that is performed. A prong embedded through the outer insulative jacket to the outer braid conductor provides mechanical and electrical contact to the outer braid conductor. Problems associated with crimping the end include that, upon insertion, the center wire can bend or be misguided so when the crimp occurs, no mechanical or electrical connection is achieved. Moreover, stray wires in a filament-type center conductor may fold back and cause electrical shorting if there is inadequate insulation between the outer and inner conductor shells of the connector plug. Finally, the crimp force of a single point crimp may deform the center conductor pin, which causes the center conductor pin to be mis-shapened so it cannot be properly inserted into the receptor portion of the coaxial connection assembly.

Accordingly, what is needed is an improved coaxial connector plug design and method of solderlessly connecting the connector to a coaxial cable that avoids the above problems. In addition, the method should reduce the cost of labor and improve the yield rate of commercial product.

SUMMARY OF THE INVENTION

According to the present invention, an improved coaxial cable connector for attaching to a coaxial cable is disclosed. Typically, the coaxial cable to which the coaxial cable connector is connected includes a center wire, a center wire insulating barrier, an outer conductive shielding wire, and an outer insulative jacket. The improved cable connector comprises a center conductor pin, which may be hollow or solid, for providing electrical conductivity for the center wire, an outer conductor shell, which is concentric to the center pin, for providing electrical conductivity for the shielding wire, and an annular dielectric, such as a phenolic washer, mounted to the center conductor pin for insulating the conductor pin from the outer conductor shell. The improvement lies in the use of an inner wire receptor having a funnel portion for receiving the center wire and a holding portion for mechanically and electrically securing the center wire. The connector is further improved by included an outer wire receptor which mechanically and electrically secures the shielding wire, and an insulator receptor, which insulates the center wire and inner wire receptor from the shielding wire and outer wire receptor. The outer wire receptor is further improved by including a funnel portion concentric with the funnel portion of the inner wire receptor. Likewise, the insulator receptor also includes a funnel portion concentric with the funnel portion of the inner wire receptor.

To achieve the mechanical connection, each receptor is crimped in at least three spaced apart positions about the circumference of both receptors. This method of crimping minimizes the deformation of both the conductor shell and the center pin.

In addition, an insulative cover is placed over the outer surface of the conductor shell, the outer wire receptor, and a portion of the coaxial cable. This provides protection from unwanted moisture, dirt, or debris that might effect the electrical and connective integrity between the center wire, the inner wire receptor and between the conducting sleeve, and outer wire receptor.

The improved coaxial connector described above lends itself to an improved method for attachment to a coaxial cable. The steps include: exposing the wire shield on at least one end of the coaxial cable; overlaying the exposed portion of the wire shield over a portion of the outer insulator, thereby exposing an end portion of the inner insulator; removing a portion of the inner insulator, thereby exposing the center wire at one end of the coaxial cable; loading the coaxial cable into the coaxial connector by guiding the center wire through the wire receptor with the exposed center wire coming to rest in the holding portion of the first wire receptor and the wire shield coming to rest in the holding portion of the second wire receptor; crimping the first wire receptor holding portion to provide mechanical and electrical connectivity between the coaxial cable and the connector.

Testing of the center pin for electrical continuity is performed either before or after the crimping step is performed. For improved results, the second wire receptor holding portion is crimped to provide additional mechanical and electrical connectivity between the coaxial cable and connector.

DETAILED DESCRIPTION OF THE SPECIFIC EMBODIMENTS

Figure 1:
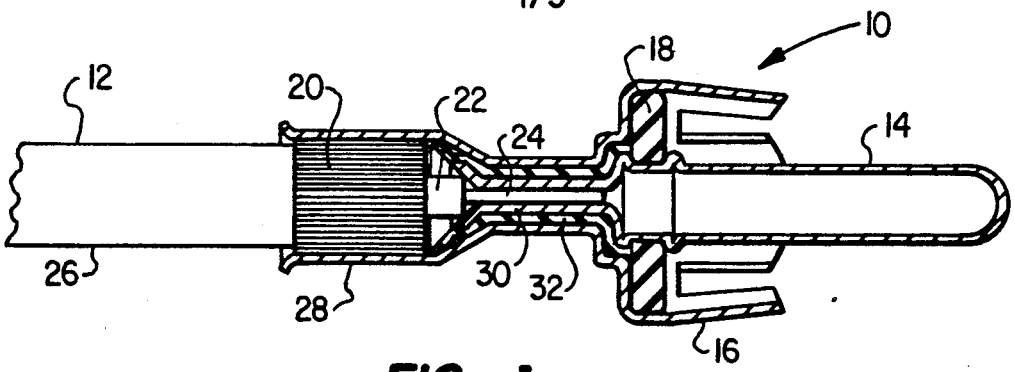
FIG. 1 is a cross-sectional illustration of a coaxial connector plug attached to a coaxial wire according to the present invention.

A cross-sectional view of a coaxial cable connector plug 10 as attached to a coaxial cable or wire 12, is illustrated in FIG. 1. Plug 10, such as an RCA-type plug, includes a cylindrical center pin 14 and a conductive housing 16, which is separated from cylindrical center pin 14 by an insulating washer 18. Wire 12 includes a braided conductive shield 20, an inner insulative sleeve 22 and a center conductor wire 24. Wire 12 further includes an outer insulative jacket 26. Connector plug 10 further includes a cable receptor portion 28, which is an extension of outer shell 16, to receive the end of cable 12 for insertion into connector plug 10. Inner wire 24 inserts into a second cable receptor portion 30, which is connected to center pin 14, and which is separated from outer receptor portion 28 by an insulating barrier 32. Connector plug 10 is described in greater detail below, after the description of the connection of connector plug 10 to wire 12.

Figure 3A:
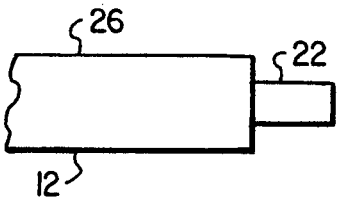
FIGS. 3A–3F illustrate the steps of FIG. 2 in the manufacture of the coaxial connector plug/wire assembly.
Figure 3B:
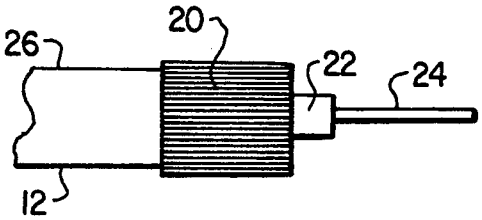
Figure 3C:
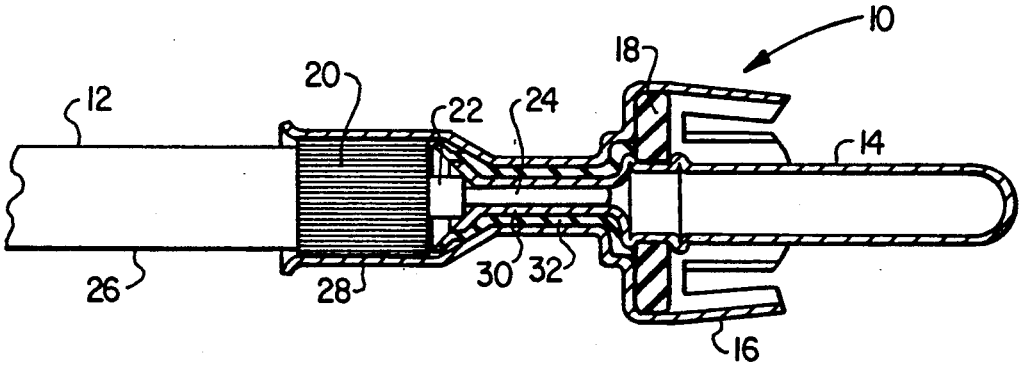
Figure 2:
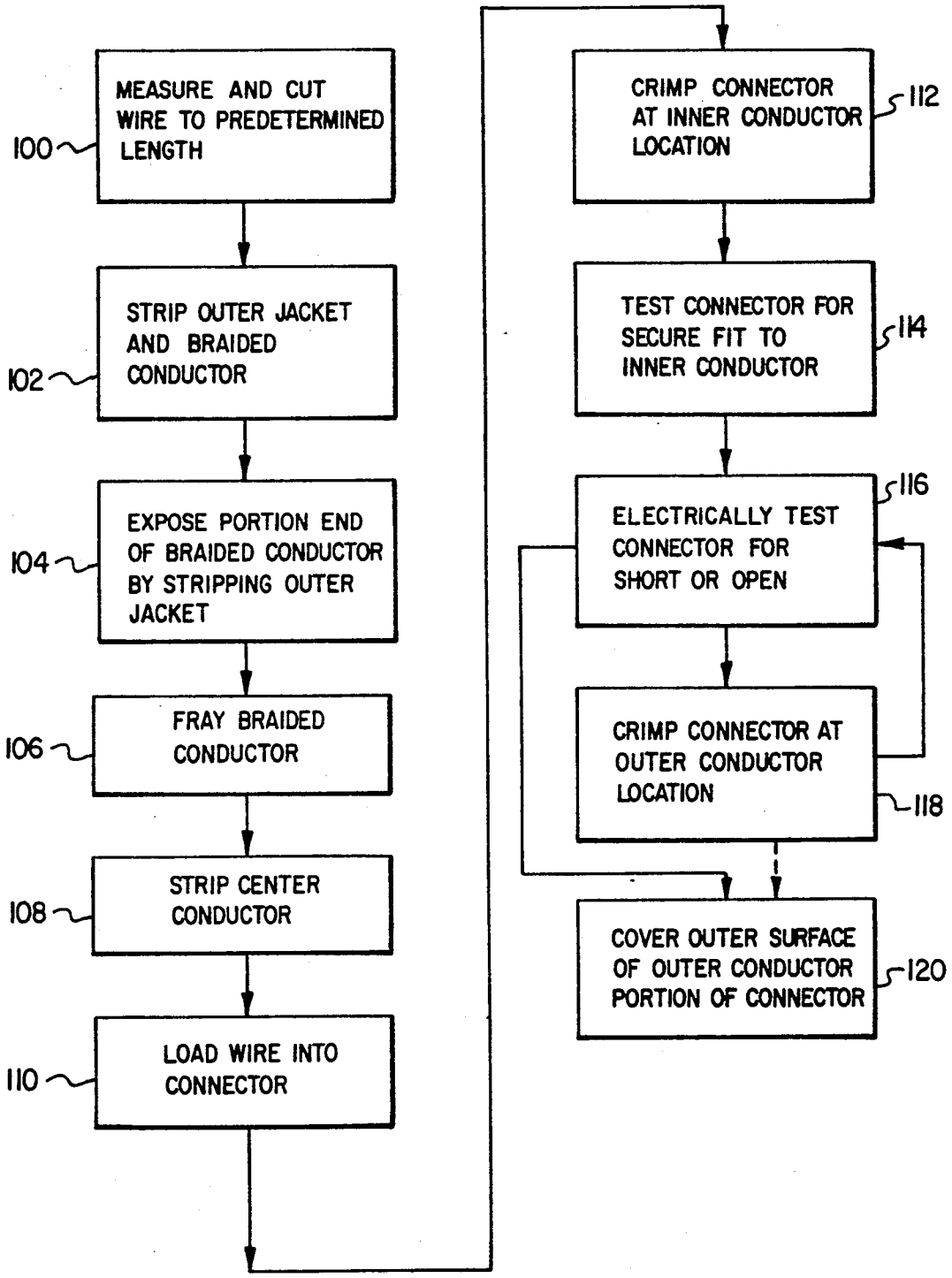
FIG. 2 is a flow chart describing the steps used in the manufacture of the coaxial cable/wire assembly according to the present invention.

The steps for attaching connector plug 10 to wire 12 are shown in FIG. 2 and illustrated in FIGS. 3A–3D. In step 100, the conductor cable is measured and cut to a predetermined length. Afterwards, in step 102, the outer jacket 26 and a portion of the braided conductor 28, as illustrated in FIG. 3A, are stripped away to expose the inner insulative sleeve 22. In step 104, as illustrated in FIG. 3B, outer jacket 26 is stripped and braided conductor 20 is exposed, which is de-braided or frayed and pulled back against outer jacket 26 to expose inner sleeve 22 (step 106). In step 108, inner insulative sleeve 22 is stripped to expose center wire 24.

The wire end is now ready for insertion into connector plug 10. The insertion of wire 12 into connector plug 10 is cross-sectionally illustrated in FIG. 3C. Due to the design of wire receptor portions 28 and 30, inner conductor wire 24 can be inserted without the bending or fraying of the leads, which might otherwise lead to a short upon final assembly (step 110).

Figure 3D:
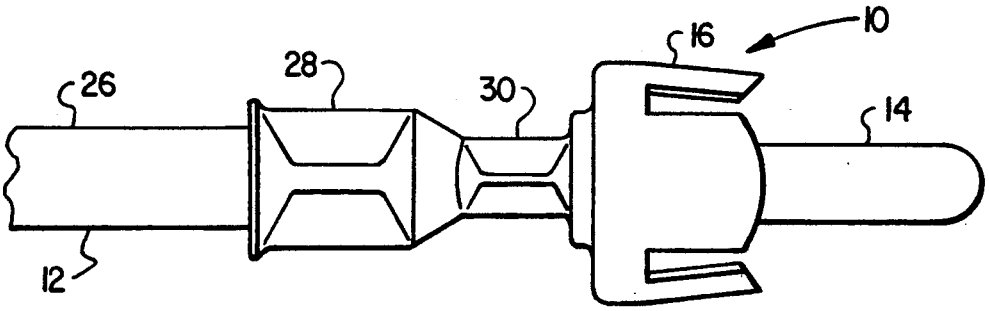
Figure 3F:
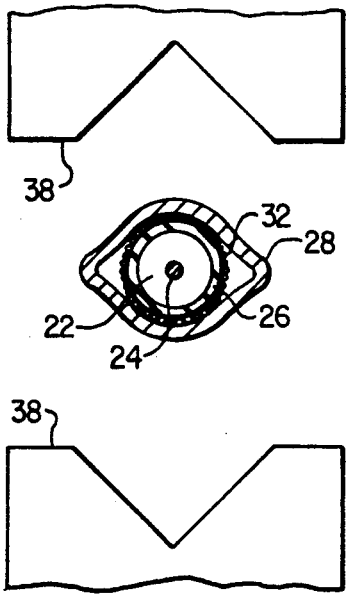
Figure 3E:
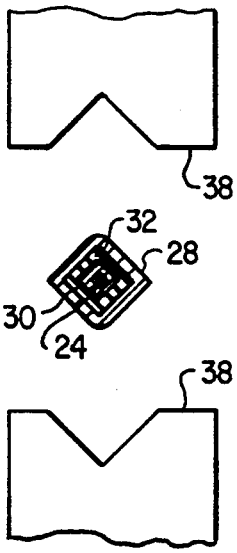

Once the center lead is in position in step 112, the center lead is mechanically and electrically connected to conductor plug 10 by crimping the outer portion of receptor portion 30 on the inner conductor wire. After crimping, connector plug 12 is tested for secure fit or for conductivity by either pulling on the plug (step 114), or applying a voltage on one end of the cable and measuring the voltage on the other end (step 116), or both. If the cable passes testing in step 118, receptor portion 28 is crimped for added mechanical connectivity, after which, an electrical test may be conducted to verify that electrical integrity has been maintained. Preferably, the crimping, as illustrated in FIG. 3D, is achieved by providing at least three crimp dice about the circumference of the receptors. The dice are equally spaced apart so that the crimp pressure does not deform either the outer shell or the center pin. In step 120 the connector plug 10 is provided an insulative outer coating on the outer surface of outer conductive shell 16 and on a portion of wire 12 extending out the back of plug 10. FIG. 3D is an illustrative example of the crimping of both sections of conductor plug 10. FIG. 3E and FIG. 3F illustrate how crimp dice 38 are used to crimp receptor portion 30 and 28, respectively.

Figure 4:
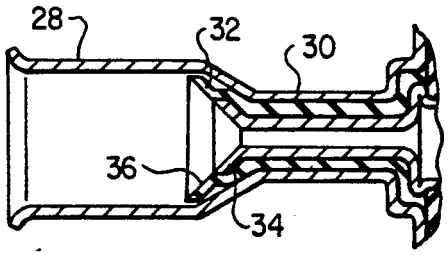
FIG. 4 is a cross-sectional illustration of the outer wire receptor portion and the inner wire receptor portion of the coaxial connector plug according to the present invention.

To illustrate more clearly the wire receptor portions 28 and 30 of connector plug 10, a cut-away view is shown in FIG. 4. Receptor portion 28 is separated from receptor portion 30 by an insulator barrier 32. The opening of receptor portion 30 is provided with a funnel shape for directing the inner wire 24 upon insertion. This funnel portion 34 prevents the wire from bending upon insertion. Likewise, insulator 32 also is formed with a funnel portion 36 to prevent deformation of the inner wire upon insertion. The diameter of outer receptor portion 28 is sufficient to accommodate the diameter of outer jacket 26 of wire 12 along with the added thickness of the frayed wire pulled back on outer jacket 26. Insulation barrier 32 further prevents contact of the frayed wire portion of braided shield 20 from contacting receptor portion 30. This design prevents electrical shorting or malfunctioning during the assembly of the outer plug and wire unit.

Figure 5A:
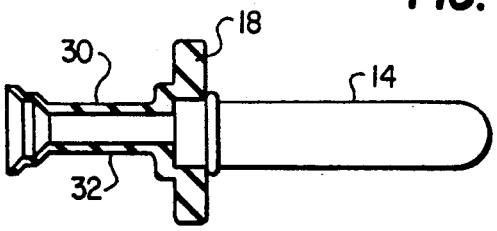
FIGS. 5A and 5B illustrate specific embodiments of the center pin portion and insulative washer assembly according to the present invention.
Figure 5B:
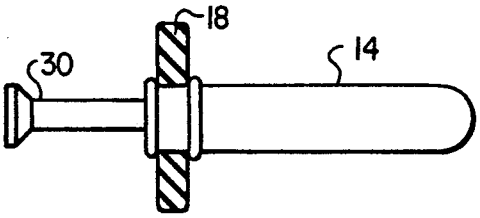

FIG. 5 illustrates specific embodiments of center pin 14 and receptor portion 30. In FIG. 5A, center pin 14-receptor portion 30 combination includes a molded insulative washer 18, which is a single piece construction including insulator portion 32. Next, in FIG. 5B, the annular insulative washer 18, retained in position by two bead lines, is illustrated to be separate from insulator portion 32.

Figure 6A:
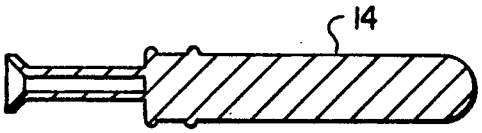
FIGS. 6A and 6B illustrate specific embodiments of the center pin according to the present invention.
Figure 6B:
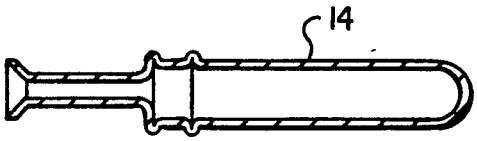

FIG. 6 illustrates two embodiments of the center pin 14. In FIG. 6A, center pin 14 has a solid construction, and is made from a rigid conductive metal, such as brass or steel, or other type metal normally used in the manufacture of coaxial cable connectors. In FIG. 6B, center pin 14 has a hollow shell, rather than a solid connector.

As can be appreciated, the coaxial connector plug and method of assembly according to the present invention provide a significant improvement over the art since a simple and inexpensive coaxial connector can be used in a manner that provides a quick and complete electrical connection of the components while assuring that no malfunction would occur that normally occurs during the soldering process of typical assembly methods.

It is understood that these forms of embodiment have been presented only by way of particular examples and do not constitute a limitation of the invention. For example, rather than a standard RCA plug as illustrated in the accompanying figures, the coaxial connector may be, for instance, a UHF type connector, or other type connector, without departing from the spirit of the present invention. Accordingly, various modifications are contemplated and may obviously be resorted to by those skilled in the art without departing from the scope of the invention as hereinafter defined by the appended claims.

What is claimed is:

1. An improved solderless coaxial cable connector for attaching to a coaxial cable having a center wire, a center wire insulating barrier, an outer conductive shielding wire, and an outer insulative jacket, the cable connector comprising at a first end a center conductor pin for providing an electrically conductive path for said center wire, at a middle section an outer conductor shell for providing an electrically conductive path for said shielding wire, and an annular dielectric mounted to said center conductor pin to insulate said conductor pin from said outer conductor shell, the improvement comprising:

at a second end, an inner wire receptor, electrically coupled to said center conductor pin, having a guide portion for receiving and guiding said center wire, said guide portion having a tapered first end and a second end wider than said first end, and a holding portion for mechanically and electrically securing said center wire, said first end of said guide portion connected to said holding portion;

at said second end, an outer wire receptor, electrically coupled to said outer conductor shell, for mechanically and electrically securing said shielding wire; and at said second end, an insulator receptor for electrically insulating said center wire and said inner wire receptor from said shielding wire and said outer wire receptor.

2. The invention of claim 1 wherein said insulator receptor comprises a funnel portion concentric with said funnel portion of said inner wire receptor.

3. The invention of claim 1 wherein said outer wire receptor comprises a funnel portion substantially concentric with said funnel portion of said inner wire receptor.

4. The invention of claim 1 wherein said annular barrier is mounted on one end of said center pin, and said holding portion of said inner wire receptor is connected to said end of said center pin to which said annular barrier is mounted.

5. The invention of claim 1 wherein said center pin is solid.

6. The invention of claim 1 wherein said center pin is hollow.

7. The invention of claim 1 further comprising an insulative cover over the outer surface of said conductor shell and said outer wire receptor and a portion of said coaxial cable.

8. The invention of claim 1 wherein said guide portion is funnel shaped.

9. The invention of claim 1 wherein said wire receptors are mechanically attached by crimping said receptors.

10. The invention of claim 9 wherein said crimping is performed by applying equal force at a plurality of locations about the circumference of each receptor so as to minimize the deformation of either said conductor shell or center pin, or both.

11. A method for attaching a coaxial connector having a conductive center pin, a conductive outer shell separated from the center pin by an annular dielectric, first and second wire receptors, each having a guide portion having a tapered first end and a second end wider than said first end and a holding portion, said first end of said guide portion connected to said holding portion, said first and second wire receptors connected to said center pin and said outer shell, respectively, and an insulating barrier between said wire receptors, to a coaxial cable having a center wire, an outer wire shield, an inner insulator separating said center wire and said wire shield, and an outer insulator covering said wire shield, the method comprising the steps of:

exposing said wire shield at one end of said coaxial cable;

overlaying said exposed portion of said wire shield over a portion of said outer insulator, thereby exposing the end portion of said inner insulator;

removing a portion of said inner insulator, thereby exposing said center wire at the one end of said coaxial cable;

loading said coaxial cable into said coaxial connector using said guide portions of said wire receptors to guide said center wire through said wire receptors with said exposed center wire coming to rest in said holding portion of said first wire receptor and said overlaid portion of said wire shield coming to rest in said holding portion of said second wire receptor; and crimping said first wire receptor holding portion, thereby providing mechanical and electrical connectivity between said center wire and said connector.

12. The method according to claim 11 further comprising the step of electrically testing said center pin after crimping said first wire receptor holding portion.

13. The method according to claim 11 further comprising the step of electrically testing said outer shell.

14. The method according to claim 11 wherein said guide portion is funnel shaped.

15. The method according to claim 11 further comprising the step of crimping said second wire receptor holding portion, thereby providing mechanical and electrical connectivity between said wire shield and said coaxial connector.

16. The method according to claim 15 further comprising the step of molding a protective layer to the outer surfaces of said outer shell, said wire receptor holding portions, and a portion of said coaxial cable.

17. A process for producing a coaxial cable comprising a coaxial connector having a conductive center pin, a conductive outer shell separated from said center pin by an annular dielectric, first and second wire receptors, each having a guide portion having a tapered first end and a second end wider than said first end and a holding portion, said first end of said guide portion connected to said holding portion, said first and second wire receptors connected to said center pin and said outer shell, respectively, and an insulating barrier between said wire receptors, said coaxial connector attached to a coaxial wire having a center wire, an outer wire shield, an inner insulator separating said center wire and said wire shield, and an outer insulator covering said wire shield, the process comprising the steps of:

exposing said wire shield at one end of said coaxial wire;

overlaying the exposed portion of said wire shield over a portion of said outer insulator, thereby exposing the end portion of said inner insulator;

removing a portion of said inner insulator, thereby exposing said center wire at the one end of the said coaxial wire;

loading said coaxial wire into said coaxial connector using said guide portions to guide said center wire through said wire receptors with said exposed center wire coming to rest in said holding portion of said first wire receptor and the overlaid portion of said wire shield coming to rest in said holding portion of said second wire receptor; and crimping said first wire receptor holding portion, thereby providing mechanical and electrical connectivity between said center wire and said connector.

18. The process according to claim 17 further comprising the step of electrically testing said center pin after crimping said first wire receptor holding portion.

19. The process according to claim 17 further comprising the step of electrically testing said outer shell.

20. The process according to claim 17 wherein the step of crimping is performed by a force of crimping dice equally spaced about said first wire receptor holding portion to limit the deformation of said center pin.

21. The process according to claim 17 wherein said guide portion is funnel shaped.

22. The process according to claim 17 further comprising the step of crimping said second wire receptor holding portion, thereby providing mechanical and electrical connectivity between said wire shield and said coaxial connector.

23. The process according to claim 22 further comprising the step of molding a protective layer to the outer surfaces of said outer shell, said wire receptor holding portions, and a portion of said coaxial cable.

* * * * *